United States Patent [19]

Kahn

[11] 4,353,460

[45] Oct. 12, 1982

[54] POUCH FOR ARMS AND AMMUNITION

[75] Inventor: Richard D. Kahn, Johannesburg, South Africa

[73] Assignee: Kahn & Kahn Plastics (Proprietary) Limited, Edenvale, South Africa

[21] Appl. No.: 179,221

[22] Filed: Aug. 18, 1980

[51] Int. Cl.[3] ..... B65D 77/38; B65D 33/08; F42B 37/00; F42B 39/00

[52] U.S. Cl. ..... 206/3; 206/605; 206/630; 229/54 R; 229/62; 224/239

[58] Field of Search ..... 206/3, 617, 605, 608, 206/630; 229/54 R, 62; 224/239

[56] References Cited

U.S. PATENT DOCUMENTS

| | | | |
|---|---|---|---|
| 2,346,185 | 4/1944 | Perry | 224/239 |
| 2,732,111 | 1/1956 | Fogle | 206/3 |
| 2,991,000 | 7/1961 | Spees | 206/605 |
| 3,008,837 | 11/1961 | Kaplan | 229/54 R |
| 3,098,601 | 7/1963 | Anderson et al. | 206/605 |
| 3,101,887 | 8/1963 | Kugler | 229/62 |
| 3,159,096 | 12/1964 | Tocker | 229/62 |
| 3,519,197 | 7/1970 | Campbell | 229/62 |

*Primary Examiner*—William T. Dixson, Jr.
*Attorney, Agent, or Firm*—Cushman, Darby & Cushman

[57] ABSTRACT

A pouch for fire-arms and ammunition comprises water impervious laminated plastic material formed into a sealed chamber. The sealed chamber has a tag welded thereto and there are lines of weakness formed alongside the tag. Thus when the tag is subject to a sharp pull, the material of the pouch tears leaving an open rectangular slot through which the contents of the chamber can be removed. The upper portion of the pouch is reinforced internally and is provided with finger openings to facilitate carrying of the pouch.

16 Claims, 4 Drawing Figures

POUCH FOR ARMS AND AMMUNITION

FIELD OF THE INVENTION

This invention relates to pouches for arms and ammunition.

BACKGROUND TO THE INVENTION

Arms and ammunition (and particularly bullets) have previously been carried in wooden crates or boxes lined with a water impervious foil. The purpose of the foil is to prevent dust and moisture from damaging the contents and for keeping the ammunition dry. The disadvantages of carrying ammunition in this way is that, due to cost factors, large quantities of ammunition are normally placed in a single crate and once open the entire crate is then exposed to dust and moisture. Further, due to the large amount of ammunition packed in a single crate, the crate is usually extremely heavy and difficult to transport.

SHORT DESCRIPTION OF THE INVENTION

According to one aspect of the invention there is provided a pouch for arms and ammunition comprising a sealed plastic sheet means forming a water impervious chamber, a plastic strip member bonded on to said plastic sheet means, a tag member at one end of the strip member which is unattached to the plastic sheet means, a pair of parallel lines of weakness in the plastic sheet means immediately below and running along the length of the strip member, a weakness in the plastic sheet means between the lines of weakness and near the strip adjacent the tag member, and handle means to facilitate carrying the pouch, the arrangement being such that when a pull or tug is applied to the tag member, the plastic sheet means thereunder will tear at the said weakness and along the said lines of weakness leaving a slot through which the contents of the said pouch can be reached. It will be seen that the chamber will be sealed until the strip member is ripped open.

The plastic sheet means comprises preferably polyvinyl chloride, and preferably laminated polyvinyl chloride to minimize the risk of pin-holes existing thus destroying the sealing properties of the sheet means. The laminated sheet conveniently consists of a layer of virgin polyvinyl chloride to which is laminated a layer of reconstituted polyvinyl chloride.

The impervious chamber preferably consists of two pieces of plastic sheet means bonded to each other along their edges.

The strip member as well as the tag member are preferably comprised of a double layer of polyvinyl chloride, preferably laminated as described above. The strip member is bonded to the plastic sheet means preferably by high frequency welding over the entire contact areas. The lines of weakness are preferably formed on the plastic sheet member along the longitudinal edges of the area of the high frequency welding. The said weakness is preferably a pronounced line of weakness incorporated at right angles to the longitudinally extending lines of weakness and is situated therebetween. These lines of weakness are formed preferably by the weld penetrating the plastic sheet means to a part of its depth and facilitate a clean, predetermined tear in the plastic sheet means. The strip member is welded to the pouch in a preferably transverse position near the upper end of the pouch.

The handle means preferably comprises a slot or slots through which the fingers or hand may pass. The slots may be able to accomodate a belt being threaded through them. The handle means is preferably reinforced preferably by an internal reinforcing plastic sheet.

According to another aspect of the invention there is provided an intermediate product from which a pouch as described above can be formed and having an opening at its lower end, through which opening the pouch can be filled. The edges of the said opening are arranged to be welded together when the ammunition pouch has been filled so that the pouch will be air and water tight.

Embodiments of the invention will now be described by way of example with reference to the accompanying drawings.

In the drawings

Figure 1:
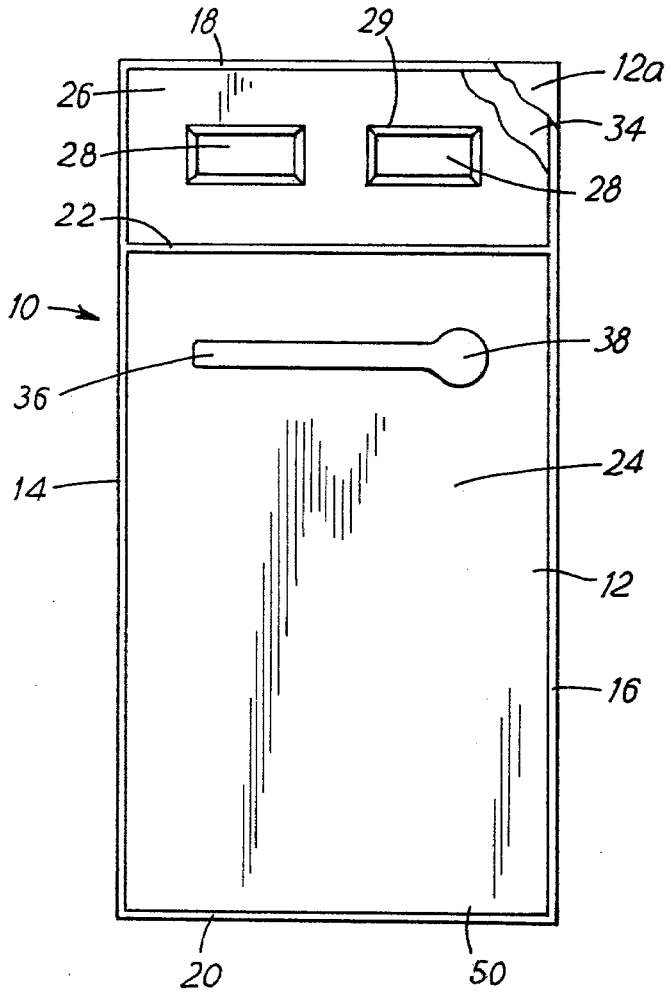
FIG. 1 is a front view partially broken away of the pouch of the invention.

Referring now to the drawings, there is shown a pouch 10 of the invention for ammunition. The pouch 10 comprises two sheets 12 and 12*a* of identical size made of laminated polyvinyl chloride. Each sheet 12 is approximately 400$\mu$ thick. The sheets 12 are joined together by means of vertical welds 14 and 16, and three horizontal welds, being the top weld 18, bottom weld 20 and intermediate weld 22. The vertical and horizontal welds cross so that areas within them are wholly sealed. The intermediate weld 22 divides the pouch 10 into two unequal parts, the lower part forming a chamber 24 and the upper part forming a handle 26. The chamber 24 is completely sealed and is thus impervious to moisture and dust.

The handle 26 has two apertures 28 reinforced by peripheral welds 29. These apertures 28 form finger holes to facilitate the carrying of the pouch 10 and also to allow several pouches 10 to be carried conveniently by a soldier in one hand. The handle 26 is reinforced by an intermediate plastic sheet 34 which is bonded to sheets 12 by welds 14, 16, 18, 22 and 29 and further provides extra strength to the handle 26.

A plastic strip 36 lies transversely across the upper quarter of the chamber 24. The plastic strip 36 has an enlarged tag 38 at its one end. The strip 36 and tag 38 consist of a bonded double layer of laminated polyvinyl chloride approximately 800$\mu$ thick and are thus stronger than the sheet 12 to which the strip is welded.

The strip 36 is welded to the front plastic sheet 12 by means of high frequency welding. The welding takes place over the entire contact area.

Lines of weakness are formed during the welding operation bounding the perimeter of the contact area 40. These lines comprise a pair of parallel lines 42 and 44 running the length of the strip and two end lines 46 and 48. The end line of weakness 46 which is closer to the tag 38 is the most pronounced of the lines of weakness. The lines of weakness 42, 44 and 48 extend to a depth in the plastic sheet 12 of between 200$\mu$ and 300$\mu$ and the line of weakness 46 about 25% deeper. These lines of weakness do not at any point penetrate the plastic sheet 12 but merely weaken the sheet, by reducing its thickness.

The pouch 10 is formed initially with its lower edges 50 open and unattached. The chamber 24 is then charged with ammunition through its open end and the lower edges 50 are then formed by the bottom weld 20. The chamber 24 which is robust is now water impervious. The charged pouches 10 can be stored in a box or similar receptacle from which they can be individually removed. This receptacle will of course have to be sufficiently strong to carry the items therein, but does not require any special waterproofing as is conventional in currently available small arms containers. This is because the chamber 24 is dust and water impervious and well protected against the ingress of foreign particles which might have a deleterious effect on the contents thereof.

Figure 2:
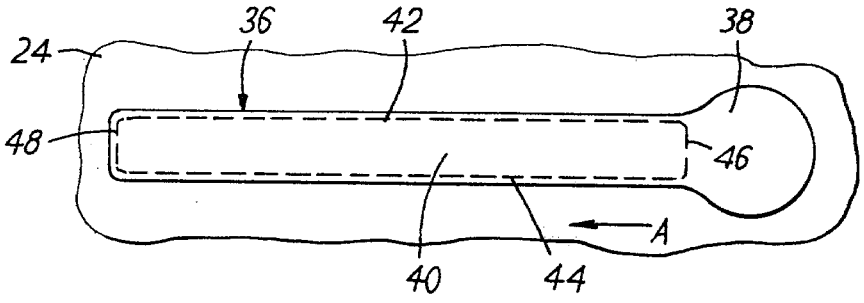
FIG. 2 is an enlarged detail view of the strip on the plastic sheet.
Figure 3:
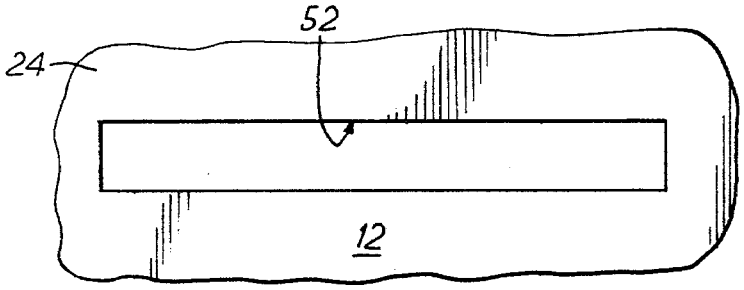
FIG. 3 is a detail front of the pouch after the strip has been torn therefrom.
Figure 4:
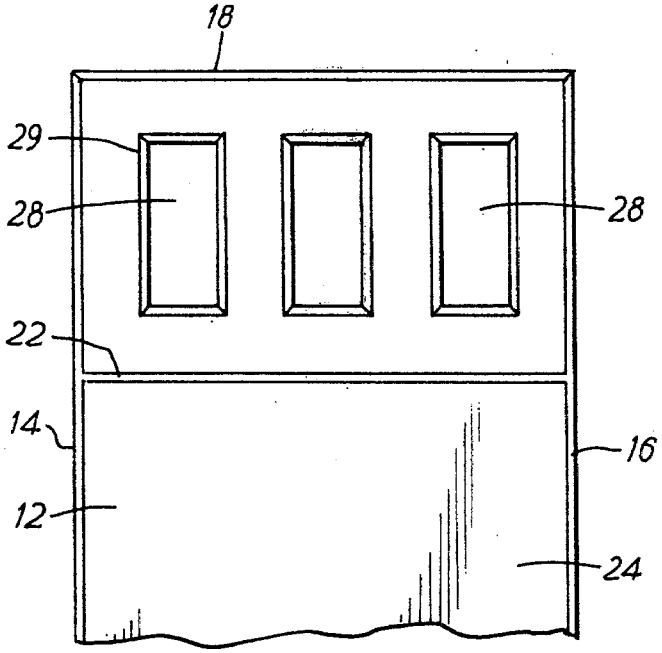
FIG. 4 is detail of an alternative pouch of the invention.

When it is desired to obtain the ammunition contained in the chamber 24, the tag 38 is raised and sharply pulled in direction of arrow A in FIG. 2. The force of the pull is transferred to the strip 36. The strip 36, being welded to the plastic sheet 12 over area 40, will tear the sheet 12 initially at line of weakness 48. Thereafter the sheet will be torn along lines of weakness 44 and 46 and finally 42 leaving a slot 52 (see FIG. 3) under area 40 through which the hand can be inserted and making the contents of the pouch accessable.

The pouch can be opened as described above extremely quickly and with a minimum of difficulty. The slot 52 is of controlled dimensions and there will not be uncontrolled tearing of the sheet. Thus the contents of the pouch will be retained in position and will not spill out of the pouches.

The opened chamber can after being emptied, be used as a carrier for water or other contents.

The chamber 24 can contain between 100 and 140 bullets. Thus when the pouch 10 is opened only this number of bullets will become exposed, as opposed to several thousand bullets contained in a foil lined box. The remaining ammunition from the container will still be in other pouches and as such protected from water and dirt.

In a further embodiment of the invention, the handle 26 has vertically elongaged apertures 28 through which a belt (not shown) e.g. a welding belt may be threaded.

The pouch being made of robust material as described can withstand rough handling. It is also strong enough to retain its contents when being carried by the handles.

As mentioned above a soldier can carry a number of pouches by grasping these through the handle apertures 28. The size of the pouches is such that these may be easily manageable and transportable by a soldier.

The invention is not limited to the precise constructional details hereinbefore described and illustrated in the drawings. For example the materials from which the pouch is formed, the thicknesses of such materials and depths of these weaknesses may vary as desired.

Further the pouch may instead be formed from a flat extruded tube. In such an arrangement it will not be necessary to provide vertical welds 14 and 16.

Furthermore, the strip 36 may be placed in a diagonal or vertical position depending on the nature of the contents which the pouch is to hold. The size of the pouch may vary as desired. The pouch may be sized to contain more or less ammunition, flares or arms such as pistols or rifles or even medical or first aid supplies.

I claim:

1. A pouch for arms and ammunition comprising
- a sealed plastic sheet means forming a water impervious chamber,
- a plastic strip member bonded on to said plastic sheet means,
- a tag member at one end of the strip member which is unattached to the plastic sheet means,
- a pair of spaced parallel lines of weakness in the plastic sheet means immediately below and running along the length of the strip member,
- a weakness in the plastic sheet means between the lines of weakness and near the strip adjacent the tag member, and handle means to facilitate carrying the pouch, the arrangement being such that when a pull or tug is applied to the tag member, the plastic sheet means thereunder will tear at the said weakness and along the said lines of weakness leaving a slot through which the contents of said pouch can be reached.

2. A pouch as claimed in claim 1 wherein the plastic sheet means comprises laminated polyvinyl chloride.

3. A pouch as claimed in claim 2 wherein the laminated plastic sheet consists of a layer of virgin polyvinyl chloride to which is laminated a layer of reconstituted polyvinyl chloride.

4. A pouch as claimed in claim 1 wherein the chamber consists of two pieces of plastic sheet means bonded to each other along their edges.

5. A pouch as claimed in claim 1 wherein the strip and tag member are comprised of a laminated polyvinyl chloride.

6. A pouch as claimed in claim 5 wherein the strip and tag member are thicker than the sheet means.

7. A pouch as claimed in claim 1 wherein the strip member is bonded to the plastic sheet means by high frequency welding over the entire contact area between said strip member and the plastic sheet means.

8. A pouch as claimed in claim 1 wherein the lines of weakness penetrate the plastic sheet means to a part of its depth.

9. A pouch as claimed in claim 1 wherein the said weakness is a line of weakness incorporated at right angles to the longitudinally extending lines of weakness and is situated therebetween near the end of the strip adjacent the tag member.

10. A pouch as claimed in claim 9 wherein the said weakness is a more pronounced weakness than the weakness at said lines of weakness.

11. A pouch as claimed in claim 1 wherein the strip member is welded to the pouch in a transverse position.

12. A pouch as claimed in claim 1 wherein the handle comprises slots able to accommodate a belt passing therethrough.

13. A pouch as claimed in claim 1 wherein the handle incorporates an internal plastic sheet.

14. An intermediate product from which a pouch as claimed in claim 1 can be formed comprising an opening at its lower end through which the chamber can be filled.

15. A pouch as claimed in claim 1 comprising a second weakness in the plastic sheet means between the said parallel lines of weakness and near the ends of the said lines of weakness remote from the tag member.

16. A pouch as claimed in claim 15 wherein the said second weakness is a line of weakness incorporated at right angles to the said parallel lines of weakness.

* * * * *